United States Patent [19]

Kanda et al.

[11] Patent Number: 4,711,733

[45] Date of Patent: Dec. 8, 1987

[54] LUBRICANT FOR THE PRODUCTION OF SEAMLESS TUBES

[75] Inventors: Noboru Kanda; Kenzou Yokoyama, both of Hiratsuka; Ken-ichi Aoki, Kanagawa; Shinji Akita, Yokohama; Masayuki Hatanaka, Yokohama; Tatsuharu Oda, Yokohama, all of Japan

[73] Assignees: Nippon Kokan Kabushiki Kaisha; Yushiro Chemical Industry Co., Ltd., both of Japan

[21] Appl. No.: 875,885

[22] Filed: Jun. 13, 1986

Related U.S. Application Data

[63] Continuation-in-part of Ser. No. 731,143, May 6, 1985, abandoned.

[30] Foreign Application Priority Data

May 15, 1984 [JP] Japan ..... 59-95619

[51] Int. Cl.[4] ..... C10M 125/02; C10M 173/02

[52] U.S. Cl. ..... 252/29; 252/49.5

[58] Field of Search ..... 252/29, 49.5

[56] References Cited

U.S. PATENT DOCUMENTS

| | | | |
|---|---|---|---|
| 4,001,125 | 1/1977 | Newton, III | 252/29 |
| 4,052,323 | 10/1977 | Feneberger et al. | 252/49.5 |
| 4,055,503 | 10/1977 | Anselment et al. | 252/29 |

FOREIGN PATENT DOCUMENTS

| | | |
|---|---|---|
| 57-185393 | 5/1981 | Japan . |
| 185393 | 6/1982 | Japan . |

*Primary Examiner*—William R. Dixon, Jr.
*Assistant Examiner*—Ellen McAvoy
*Attorney, Agent, or Firm*—Lowe, Price, LeBlanc, Becker & Shur

[57] ABSTRACT

A lubricant for the production of seamless tubes comprising water-insoluble fine synthetic resin particles, fine gilsonite and graphite, in which about 30 parts by weight of water-insoluble fine synthetic resin particles, from about 15 to about 30 parts by weight of fine gilsonite particles and from about 40 to about 55 parts by weight of fine graphite powder are contained.

8 Claims, 1 Drawing Figure

LUBRICANT FOR THE PRODUCTION OF SEAMLESS TUBES

This application is a continuation-in-part of U.S. application Ser. No. 731,143 filed May 6, 1985, now abandoned.

FIELD OF THE INVENTION

This invention concerns a lubricant for the production of seamless tubes and, more specifically, it relates to a lubricant supplied in the form of a spray coating to the surface of a mandrel bar prior to the production of seamless tubes.

BACKGROUND OF THE INVENTION

As lubricants for the production of seamless tubes, so-called oily-type lubricants comprising graphite dispersed in fuel oils and so-called water dispersion-type lubricants comprising graphite dispersed in water have generally been used.

The use of an oily-type lubricant produces a great amount of soot that contaminates working environments and is a fire hazard since the oily-type lubricant contains fuel oils. In view of the above, the use of the water dispersion-type lubricant with no such disadvantages has been preferred in recent years. However, since the water dispersion type lubricants generally have poor adhesion to the surface of mandrel bars and low resistance to water, films formed with the water dispersion type lubricants have the disadvantage of being liable to detachment during transportation of the mandrel bar.

The invention disclosed in Japanese Patent Laid-Open No. 185393/1982 by Nihon Kokan K.K. and Yushiro Kagaku Kogyo K.K. and the invention disclosed in U.S. Pat. No. 4,001,125 by A. R. Newton are directed to the improvement of such water dispersion-type lubricants as described above. Although many improvements have been attained by these inventions, they are not yet satisfactory as will be explained hereinafter.

The temperature of the mandrel bar when coated with the lubricant varies depending on the processing conditions and generally varies over a wide range of from 60° to 450° C. The lubricant comprising graphite and gilsonite which is disclosed in U.S. Pat. No. 4,001,125 is poor in adhesion to the mandrel bar and in its water-resistance property at some temperatures. In fact, if the temperature at the surface of the mandrel bar is relatively low, for example less than 100° C., the lubricant cannot provide a sufficient lubricating effect.

The invention disclosed in Japanese Laid-Open No. 185393/1982 concerns a lubricant having a glass transition point from 45° to 130° C. and preferably comprising from 5 to 15% by weight of gilsonite powder and from 70 to 90% by weight of graphite dispersed in water. However, this lubricant is less adhesive to the mandrel bar if the temperature of the surface of the mandrel bar is higher than 250° C., and therefore it cannot provide sufficient lubrication. This Japanese reference also discloses lubricants for water dispersion containing 20 weight % resin, 15 or 20 weight % gilsonite powder and 60 or 65 weight % graphite. However, these lubricants do not form homogeneous films at temperatures of from 400° to 450° C. nor do they form sufficiently thick films at these higher temperatures.

OBJECT AND SUMMARY OF THE INVENTION

The object of this invention is to overcome the drawbacks of the conventional lubricant for the production of seamless tubes as described above and provide a lubricant that adheres well to the surface of the mandrel bar at a wide range of temperatures from 60° to 450° C., does not detach from the mandrel bar during transportation due to the effects of vibration, shock, the flow of cooling water or the like, and is thus capable of providing extremely good lubricating performance.

The above described objects can be attained by the lubricant according to this invention. Specifically, the lubricant according to this invention is a lubricant for the production of seamless tubes comprising water-insoluble fine synthetic resin particles, fine gilsonite particles and graphite as essential ingredients, together with water if required. Specifically, about 30 parts by weight of fine synthetic resin particles, from about 15 to about 30 parts by weight of fine gilsonite particles and from about 40 to about 55 parts by weight of fine graphite powder are contained in the lubricant according to the invention.

BRIEF DESCRIPTION OF THE DRAWING

in FIG. 1, curve 1 represents the average value for the deposition amount of specimen oils No. 4–No. 9 curve 2 represents the deposition amount of specimen oil No. 1 (a conventional lubricant containing no gilsonite), curve 3 represents the deposition amount of specimen oil No. 3 (a conventional lubricant containing acrylic resin as low as 10% by weight (corresponding to the lubricant in Example 1 described in Japanese Patent Laid-Open No. 185393/1982) and curve 4 represents specimen oil No. 2 (a conventional lubricant containing no water-insoluble synthetic resin).

DETAILED DESCRIPTION OF PREFERRED EMBODIMENT

Figure 1:
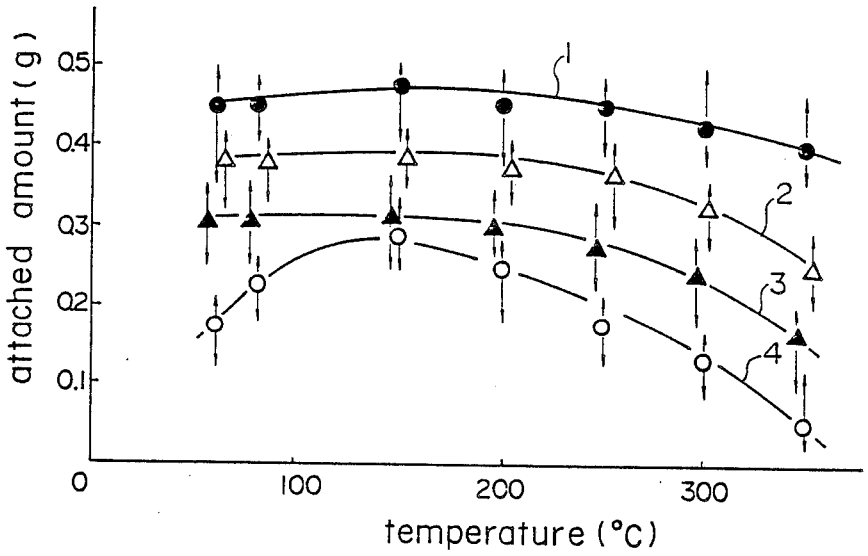
FIG. 1 is a graph illustrating the amount of lubricant attached to the mandrel bar at various temperatures for the lubricant according to this invention and conventional lubricants in comparison.

Preferred embodiments of the lubricants according to this invention are described below.

The water-insoluble fine synthetic resin particles according to this invention should be water-insoluble and have a glass transition point or temperature lower than the surface temperature of a mandrel bar coated with the lubricant. If the glass transition point of the water-insoluble synthetic resin is higher than the surface temperature of the mandrel bar, the adhesiveness of the lubricant to the mandrel bar is decreased, and it does not adhere to the mandrel bar during transportation thereof. Accordingly, such a synthetic resin having a glass transition temperature higher than the mandrel surface temperature is not preferred as an ingredient of the lubricant according to this invention. While the temperature of the mandrel bar is generally higher than 100° C., it may often be about 60° C. depending on the kinds of steel materials to be rolled or on the rolling conditions. In this case, the glass transition point of the water-insoluble synthetic resin is desirably less than 55° C., and more preferably 40° C. or less. The synthetic resin capable of satisfying the above-described conditions includes, for example, acrylic resins, polyethylenes and copolymers containing vinyl acetate.

Suitable acrylic resins include copolymers of butyl acrylate and ethyl methacrylate, copolymers of butyl acrylate and tert-butyl methacrylate, copolymers of butyl acrylate and isopropyl methacrylate, copolymers of methyl methacrylate and methyl acrylate, copolymers of methyl methacrylate and ethyl acrylate, copolymers of methyl methacrylate and butyl acrylate, copolymers of methyl methacrylate and 2-ethylhexyl acrylate.

Any of the polyethylenes prepared from a low pressure process, medium pressure process or high pressure process known in the art may be used. Referring more specifically to the examples of polyethylene, those commercially available as powder polyethylene are preferred.

Further, suitable copolymers containing vinyl acetate include, for example, copolymers of vinyl acetate - ethylene, for example, SUMIKA FLEX 500 manufactured by Sumitomo Kagaku Kogyo K.K., as well as polyvinyl acetate, copolymers of vinyl acetate and acrylic esters and copolymers of vinyl acetate and methacrylic esters. As the acrylic ester copolymerizable with vinyl acetate, methyl acrylate and ethyl acrylate are suitable and, as the methacrylic ester copolymerizable with the vinyl acetate, methyl methacrylate and ethyl methacrylate are suitable.

The glass transition point of the water-insoluble synthetic resin can optionally be controlled depending on the types of the monomers used, for example, in the case of acrylic resins, and the thus preferred glass transition point can be realized with ease.

The fine particles of the synthetic resin as described above can be prepared with ease through emulsion polymerization or suspension polymerization of monomers. The emulsion or suspension obtained by such a polymerization process may then be used as an ingredient of the lubricant according to this invention.

In this invention, gilsonite is the preferred asphalt for use. The use of asphalt other than gilsonite is not suitable since the adhesiveness of the resulting lubricant to the surface of steel materials is poor. Particularly, in the case of re-coating the lubricant, the deposition amount and the adhering strength of the resulting lubricant are extremely reduced.

The particle diameter of the fine gilsonite particles is desirably less than about 100 μm in order to form uniform coated films on the surface of the mandrel bar. Additionally, particles of this size facilitate the ease of maintenance of a lubricant supplying device.

For further information concerning gilsonite, reference can be made to Kirk-Othmer Encyclopedia of Chemical Technology, Third Edition, Vol. 11, page 802–803 and U.S. Pat. No. 4,001,125.

In this invention, either pulverized amorphous graphite or pulverized flake graphite may be used. The particle diameter of the fine graphite powder is desirably less than about 100 μm in order to form uniform films of the lubricant on the surface of the mandrel bar, and, as set forth above, to facilitate the ease of maintenance of the lubricant supplying device.

While the lubricant according to this invention comprises fine graphite powder, fine gilsonite particles and water-insoluble fine synthetic resin particles as the essential ingredients, other ingredients such as, for example a surface active agent, high polymer dispersion stabilizers and alkaline substances may be added in order to stably disperse the lubricant in water. Since the admixture of such auxiliary ingredients does not reduce the effect of this invention, the surface active agent, high polymer dispersion stabilizer and alkaline substance may optionally be added as required. The surface active agent usable in this invention includes, for example, the sodium salt and the potassium salt of alkyl sulfonic acid. Further, the high polymer dispersion stabilizer usable herein may include carboxymethylcellulose (CMC) and sodium alignate. Furthermore, the alkaline material usable herein may include, for example, ammonia and amine.

The lubricant according to this invention can be used while diluted with water if desired. The degree of dilution varies depending on the processing conditions and coating conditions. The lubricant is preferably diluted, approximately, to such a concentration so that the total amount of fine graphite powder, water-insoluble fine synthetic resin particles and fine gilsonite particles, or the total amount of fine graphite powder, water-insoluble fine synthetic resin particles, fine gilsonite particles and auxiliary ingredients is from 40 to 70% by weight of the diluted solution.

Preferred examples will be shown below for better understanding of this invention. It should, however, be noted that the following examples are described for the explanation of this invention and these examples do not restrict the scope of the present invention.

EXAMPLE 1 (SPECIMEN OIL NO. 6)

A lubricant composition comprising the following ingredients was prepared:

| | |
|---|---|
| Fine powder of amorphous graphite: (Average particle diameter of 3 μm. The particle diameter is the same in the subsequent Examples and Comparative Examples) | 40 parts by weight |
| Fine powder of acrylic resin: (Copolymer of 73 parts by weight of methyl methacrylate and 27 parts by weight of butyl acrylate, number average molecular weight of 150,000, weight average molecular weight of 1,100,000 (each determined by high-speed liquid chromatography), they are the same in the subsequent Examples 2 and 5) | 30 parts by weight |
| Fine gilsonite particles: (Average particle diameter of 5 μm. The particle diameter is the same in the subsequent Examples and Comparative Examples) | 30 parts by weight |

50 parts by weight of the above mentioned composition were added to and dispersed in 50 parts by weight of water. The thus obtained liquid dispersion of the lubricant was continuously applied to the hot rolling of seamless tubes using a mandrel mill, to prepare 600 seamless tubes. In this case, the liquid dispersion of the lubricant was coated by air spray to the mandrel bar moving at a speed of 2.5 m/sec and a surface temperature from 60° to 370° C.

The films of the lubricant formed by the coating were well and uniformly adhered to the mandrel bar even at a temperature higher than 250° C. The film thickness of the lubricant layer was adjusted so as to be between 40 and 60 μm. The thus formed films of the lubricant were sufficiently resistant to the vibrations and impact shocks attendant to the transporation of the mandrel bar and to the flow of the mandrel bar cooling water and no detachment of the lubricant films was recognized. Thus, the coefficient of friction of the mandrel bar when using the lubricant in this example was reduced to less than 60% as compared with a coefficient of friction of the mandrel bar when using a conventional lubricant as described in Japanese Patent Laid-Open No. 185393/182 and including 80 parts by weight graphite, 10 parts by weight gilsonite and 10 parts by weight resin. Further, the electric power consumed for driving the mill was reduced to about 80% when the lubricant of this example was used as compared with the use of the comparative conventional lubricant. Furthermore, welding injuries were significantly decreased in the thus obtained seamless tube products and the quality thereof was significantly improved.

EXAMPLE 2 (SPECIMEN OIL NO. 7)

A lubricant composition comprising the following ingredients was prepared:

| | |
|---|---|
| Fine powder of amorphous graphite | 55 parts by weight |
| Fine powder of acrylic resin | 30 parts by weight |
| Fine powder of gilsonite | 15 parts by weight |

The above-mentioned composition was applied to the mandrel mill in the same manner as in Example 1 and 800 seamless tubes were continuously manufactured through hot rolling. When the lubricant was coated, the surface temperature of the mandrel bar was from 60° to 390° C., the moving velocity of the mandrel bar was 2.5 m/sec and the films of the lubricant thus formed were well and uniformly adhered to the mandrel bar even at the highest temperatures. The thickness of the films of the lubricant was adjusted to between 30 and 50 μm. The thus processed mandrel mill, after being transported in the same manner as in Example 1, was served for the rolling of steel materials. As the result, in comparison with the use of the comparative conventional lubricant described in Japanese Patent Laid-Open No. 185393/1982, the coefficient of friction of the mandrel bar was reduced to less than 60% when the lubricant of this example was used, and the mill driving power was reduced to about 80%. Furthermore, welding injuries were significantly reduced for the thus obtained seamless tube products and the quality thereof was significantly improved.

EXAMPLE 3 (SPECIMEN OIL NO. 8)

A lubricant composition comprising the following ingredients was prepared:

| | |
|---|---|
| Fine powder amorphous graphite | 55 parts by weight |
| Fine powder of polyethylene with viscosity average molecular weight of 18,000 (commercially available as powder polyethylene) | 30 parts by weight |
| Fine powder of gilsonite | 15 parts by weight |

The above-mentioned composition was continuously applied to the hot rolling of seamless tubes by the mandrel mill in the same manner as in Example 1 and 800 seamless tubes were manufactured. When the lubricant was coated, the surface temperature of the mandrel bar was from 50° to 380° C., the moving velocity of the mandrel bar was 2.5 m/sec and the coated films of the lubricant thus formed were well and uniformly adhered to the mandrel bar even at a temperature higher than 250° C. The thickness of the coated films of the lubricant was adjusted to between 25 and 40 μm. The thus processed mandrel mill, after being transported in the same manner as in Example 1, was served for the rolling. As the result, in comparison with the use of the comparative conventional lubricant described in Japanese Patent Laid-Open No. 185393/1982, the coefficient of friction of the mandrel bar was reduced to less than 60% and the mill driving power was reduced to about 80% when the lubricant of this example was used. Furthermore, welding injuries were significantly reduced for the thus obtained seamless tube products and the quality thereof was significantly improved.

EXAMPLE 4 (SPECIMEN OIL NO. 9)

A lubricant composition comprising the following ingredients was prepared:

| | |
|---|---|
| Fine powder of amorphous graphite | 55 parts by weight |
| Copolymer of 83 parts by weight of vinyl acetate and 17 parts by weight of ethylene (manufactured by Sumitomo Kagaku Kogyo K.K., Trade name, SUMIKA FLEX 500) | 30 parts by weight |
| Fine powder of gilsonite | 15 parts by weight |

The above mentioned composition was continuously applied to the hot rolling of seamless tubes by the mandrel mill in the same manner as in Example 1 and 800 seamless tubes were manufactured. When the lubricant was coated, the surface temperature of the mandrel bar was from 60° to 380° C., the moving velocity of the mandrel bar was 2.5 m/sec and the films of the lubricant thus formed were well and uniformly adhered to the mandrel bar even at a temperature higher than 250° C. The thickness of the coated films of the lubricant was adjusted to between 25 and 40 μm. The thus processed mandrel mill, after being transported in the same manner as in Example 1, was served for the rolling. As a result, in comparison with the use of the comparative conventional lubricant described in Japanese Patent Laid-Open No. 185393/1982, the coefficient of friction of the mandrel bar was reduced to less than 60% and the mill driving power was reduced to about 80% when the lubricant of this example was used. Furthermore, welding injuries were significantly reduced for the thus obtained seamless tube products and the quality thereof was significantly improved.

EXAMPLE 5 (SPECIMEN OIL NO. 7)

A lubricant composition comprising the following ingredients was prepared:

| | |
|---|---|
| Fine powder of flake graphite | 55 parts by weight |
| Fine powder of acrylic resin | 30 parts by weight |
| Fine powder of gilsonite | 15 parts by weight |

The above-mentioned composition was continuously applied to the hot rolling of seamless tubes by the mandrel mill in the same manner as in Example 1 and 700 seamless tubes were manufactured. When the lubricant was coated, the surface temperature of the mandrel bar was from 60° to 380° C., the moving velocity of the mandrel bar was 2.5 m/sec and the films of the lubricant thus formed were well and uniformly adhered to the mandrel bar even at a temperature higher than 250° C. The thickness of the coated films of the lubricant was adjusted to between 25 and 40 μm. The thus processed mandrel mill, after being transported in the same manner as in Example 1, was served for the rolling. As a result, in comparison with the use of the comparative conventional lubricant described in Japanese Patent Laid-Open No. 185393/1982, the coefficient of friction of the mandrel bar was reduced to less than 60% and the mill driving power was reduced to about 80% when the lubricant of this example was used. Furthermore, welding injuries were significantly reduced for the thus obtained seamless tube products and the quality thereof was significantly improved.

COMPARATIVE COMPOSITION 1

The comparative conventional composition disclosed in Example 1 of the Japanese Patent Laid Open No. 185393/1982 was prepared from the following ingredients:

| | |
|---|---|
| Amorphous graphite | 80 parts by weight |
| Gilsonite powder | 10 parts by weight |
| Copolymer latex (9 parts by weight of methyl methacrylate and 1 part by weight of butyl acrylate content (concentration 25% by weight) | 40 parts by weight (10 parts by weight of solid content) |

The above mentioned composition was added to and dispersed in water into 30 wt % concentration. The films of this lubricant which were subject to the comparative tests set forth in Examples 1–5 were prepared in the same manner as in Example 1 except that the thickness of the lubricant films was adjusted to about 100 μm.

COMPARATIVE COMPOSITION 2

A second comparative composition was prepared including the following ingredients:

| | |
|---|---|
| Synthetic resin | 20 parts by weight |
| Gilsonite | 15 parts by weight |
| Graphite | 65 parts by weight |

COMPARATIVE COMPOSITION 3

A third comparative composition was prepared including the following ingredients:

| | |
|---|---|
| Synthetic resin | 20 parts by weight |
| Gilsonite | 20 parts by weight |
| Graphite | 60 parts by weight |

TEST EXAMPLE 1

The lubricants of Examples 2–5 and Comparative Compositions 2 and 3 were each coated on mandrel bars having surface temperatures of from 400°–450° C. The lubricants of Examples 2–5 according to the present invention formed homogeneous films having thicknesses of from 20–40 μm. The lubricants of Comparative Compositions 2 and 3 did not form homogeneous films and the non uniform films which were formed from these lubricants had thicknesses of up to only 15 μm. The coated mandrels were subject to the hot rolling of seamless tubes in the same manner as in Example 1, after which the coefficient of friction of the mandrel bars coated with Comparative Compositions 2 and 3 were at least 20% greater than the coefficients of friction of the lubricants of Examples 2–5 according to the present invention. Additionally, when the lubricants of Comparative Compositions 2 and 3 were used, the amount of electric power required for driving the mandrel mill was 25% greater than that required when the lubricants of Examples 2–5 according to the present invention were used. Moreover, the seamless tube products produced using the lubricants of the Comparative Compositions 2 and 3 included significantly more welding defects than those produced using the lubricants of Examples 2–5 according to the present invention. Thus, the lubricants according to the present invention provided improved performances as compared with those of Comparative Compositions 2 and 3.

Thus, an important advantage of this invention resides in that the adhesiveness of the lubricant to the mandrel bar at various temperatures, particularly at temperatures at or above about 400° C., is improved and films of lubricant exhibiting excellent lubricity were formed by the combined use of fine gilsonite particles, water-insoluble fine synthetic resin particles and graphite in an optimal combination comprising about 30 parts by weight fine synthetic resin particles, from about 15 to about 30 parts by weight of fine gilsonite particles and from about 40 to about 55 parts by weight of fine graphite powder.

Additional Test Examples are shown below to demonstrate further improvements obtained by the combined use according to the present invention of fine gilsonite particles, various water-insoluble synthetic resins, and graphite and the adhesiveness of such compositions to the mandrel bar and the water resistant properties of these lubricants.

TEST EXAMPLE 2

Lubricants were coated on a mandrel bar travelling at a velocity of 1–5 m/sec. The lubricants were coated under the dynamic conditions shown in Table 1.

TABLE 1

| Method of Coating Lubricant | |
|---|---|
| Pump | Airless pump DR160B manufactured by Yamada Yuki Seizo Co. Ltd. (theoretical pressure multiplying factor 1:10) |
| Spray gun | Automatic gun 24AUA manufactured by Spraying System Co. |
| Nozzle | ϕ 0.61 mm |
| Spray distance | 200 mm |
| Discharge pressure (air pressure) | 4.0 kg/cm$^2$ |
| Object to be coated | 90 mm diameter × 4 mm thickness × 150 mm length (steel pipe) |
| Temperature for the object to be coated | 60–350° C. |
| Transferring velocity of the object to be coated | about 3 m/sec |
| Spray system | automatic gun is fixed while the object to be coated is transferred |
| Items to be measured | State of deposition (visually measured)<br>Amount of deposition<br>Adhering strength<br>Water resisting property |

Lubricants were spray coated on the objects to be coated at various temperatures under the various conditions shown in Table 1. The objects to be coated were left for 10 sec after the completion of the coating and, thereafter, were completely immersed in cold water. The strength and the water resistance properties of the coated films of the lubricant were estimated by touching the coated objects with fingers in cold water.

The lubricants tested according to this method are set forth in Table 2.

TABLE 2

| Specimen Oil | Synthetic resin (wt %) | | | | |
|---|---|---|---|---|---|
| | acrylic resin (Tg 40° C.) | poly-ethylene (Tg 0° C.) | copolymer containing vinyl acetate (Tg 0° C.) | Gil-son-ite | Graph-ite |
| Specimen Oil No. 1 (Comparative) | 50 | | | | 50 |
| Specimen Oil No. 2 (Comparative) | | | | 50 | 50 |
| Specimen Oil No. 3 (Comparative) | 10 | | | 10 | 80 |
| Specimen Oil No. 4 (Comparative) | 20 | | | 15 | 65 |
| Specimen Oil No. 5 (Comparative) | 25 | | | 15 | 60 |
| Specimen Oil No. 6 | 30 | | | 30 | 40 |
| Specimen Oil No. 7 | 30 | | | 15 | 55 |
| Specimen Oil No. 8 | | 30 | | 15 | 55 |
| Specimen Oil No. 9 | | | 30 | 15 | 55 |

All of the specimen oils were tested in an aqueous suspension at 50 wt % concentration. The acrylic resin is as described in Example 1. The polyethylene is as described in Example 3. The copolymer containing vinyl acetate is the resin as described in Example 4. Tg represents the glass transition point.

The film forming behavior of the lubricants at various temperatures and the physical properties of the thus formed coated films of the lubricants were examined. The results are shown in Table 3, Table 4 and Table 5, as well as in FIG. 1.

TABLE 3

| State of the Coated Films | Temperature (°C.) | | | | | | | |
|---|---|---|---|---|---|---|---|---|
| | 60 | 80 | 100 | 150 | 200 | 250 | 300 | 350 |
| Specimen Oil No. 1 | A | A | A | A | A | A | C | C |
| Specimen Oil No. 2 | C | C | C | B | B | B | C | C |
| Specimen Oil No. 3 | A | A | A | A | A | B | C | C |
| Specimen Oil No. 4 | A | A | A | A | A | A | A | A |
| Specimen Oil No. 5 | A | A | A | A | A | A | A | A |
| Specimen Oil No. 6 | A | A | A | A | A | A | A | A |
| Specimen Oil No. 7 | A | A | A | A | A | A | A | A |
| Specimen Oil No. 8 | A | A | A | A | A | A | A | A |
| Specimen Oil No. 9 | A | A | A | A | A | A | A | A |

wherein:
A: Formation of continuous films
B: Formation of somewhat uneven films
C: Formation of uneven films containing not-coated areas.

TABLE 4

| Water Resistance | Temperature (°C.) | | | | | | | |
|---|---|---|---|---|---|---|---|---|
| | 60 | 80 | 100 | 150 | 200 | 250 | 300 | 350 |
| Specimen Oil No. 1 | B | A | A | A | A | A | A | A |
| Specimen Oil No. 2 | C | C | C | C | A | A | A | A |
| Specimen Oil No. 3 | C | C-B | A | A | A | A | A | A |
| Specimen Oil No. 4 | B | A | A | A | A | A | A | A |
| Specimen Oil No. 5 | B | A | A | A | A | A | A | A |
| Specimen Oil No. 6 | B | A | A | A | A | A | A | A |
| Specimen Oil No. 7 | B | A | A | A | A | A | A | A |
| Specimen Oil No. 8 | B | A | A | A | A | A | A | A |
| Specimen Oil No. 9 | B | A | A | A | A | A | A | A |

wherein:
A: Represents that the films were not peeled off and there was very little or no contamination to the fingers.
B: Represents that the films at least partially peeled off and there was a medium degree of contamination to fingers.
C: Represents that the films completely peeled off.

TABLE 5

| Relationship Between the Deposition Amount and Temperature | | Temperature (°C.) | | | | | | |
|---|---|---|---|---|---|---|---|---|
| | | 60 | 80 | 150 | 200 | 250 | 300 | 350 |
| Specimen Oil | A | 0.32 | 0.33 | 0.35 | 0.33 | 0.30 | 0.27 | 0.20 |
| No. 1 | B | 0.42 | 0.40 | 0.42 | 0.41 | 0.40 | 0.35 | 0.29 |
| Specimen Oil | A | 0.12 | 0.17 | 0.24 | 0.18 | 0.13 | 0.08 | 0.03 |
| No. 2 | B | 0.21 | 0.25 | 0.33 | 0.30 | 0.22 | 0.16 | 0.13 |
| Specimen Oil | A | 0.25 | 0.25 | 0.24 | 0.26 | 0.23 | 0.17 | 0.10 |
| No. 3 | B | 0.35 | 0.36 | 0.36 | 0.35 | 0.33 | 0.28 | 0.35 |
| Specimen Oil | A | 0.35 | 0.40 | 0.40 | 0.38 | 0.39 | 0.38 | 0.35 |
| No. 4–9 | B | 0.49 | 0.47 | 0.50 | 0.50 | 0.49 | 0.50 | 0.47 |

Each numerical value in Table 5 represents the deposition amount (g) of the specimen oil at the corresponding temperature. A represents the maximum value of the deposition amount of the specimen oil. B represents the minimum value of the deposition amount of the specimen oil.

FIG. 1 is a graph showing the deposition amount of the lubricant according to this invention onto the object to be coated and the deposition amount of the conventional lubricant onto the object to be coated in the test as described above. In the figure, curve 1 represents the deposition amount of the Specimen Oils No. 4 through No. 9. At these lower temperatures the comparative lubricant Specimen Oil No. 4 exhibits properties similar to those lubricants according to the invention although at higher temperatures, for example, 400°–450° C., Specimen Oil No. 4 is inferior as compared with the lubricants of the invention as set forth in Test Example 1.

Curve 2 represents the deposition amount of Specimen Oil No. 1 (a conventional lubricant containing no gilsonite), curve 3 represents the deposition amount of Specimen Oil No. 3 (the conventional comparative lubricant containing 10% by weight synthetic acrylic resin as described in Japanese Patent Laid-Open No. 185393/1982) and curve 4 represents the deposition amount of specimen oil No. 2 (a conventional lubricant containing no water-insoluble synthetic resin).

Curves 1 through 4 represent the average values for the deposition amount and the arrows along the ordinate in the figure represent the range of errors in the deposition amount.

Tables 3, 4 and 5 and FIG. 1 show that if the content of the water-insoluble synthetic resin exceeds a certain value in a mixture of water-insoluble synthetic resin, gilsonite and graphite, the adhering properties of the lubricant at each of the temperatures and the physical properties of the lubricant films are improved as compared with those in conventional lubricants. More specifically, Test Example 1 and Tables 3, 4 and 5 and FIG. 1 show that a lubricant comprising from about 30% by weight of water-insoluble synthetic resin, from about 15 to 30% by weight of gilsonite and from about 40 to 55% by weight of graphite provide films of lubricant excellent in adhesiveness at various temperatures ranging from 60° to 450° C. and superior in physical properties.

The lubricant for the production of seamless tubes according to this invention adheres well to the surface of a mandrel bar over a wide temperature range from about 60° to about 450° C., and does not detach due to the effect of vibration and shock during transportation of the mandrel bar, and the flow of cooling water. Accordingly, the lubricant for the production of seamless tubes according to this invention provides a better lubricating performance than that of conventional lubricants and can contribute to improvements in the productivity of seamless tubes.

What is claimed is:

1. A lubricant for the production of seamless tubes comprising water-insoluble fine synthetic resin particles, fine gilsonite particles and graphite as the essential ingredients together with water as required in addition to said essential ingredients, said lubricant comprising about 30 parts by weight of water-insoluble fine synthetic resin particles, from about 15 to about 30 parts by weight of fine gilsonite particles and from about 40 to about 55 parts by weight of fine graphite powder.

2. The lubricant for the production of seamless tubes as defined in claim 1, wherein the water-insoluble fine synthetic resin particles comprise a synthetic resin having a glass transition point lower than the surface temperature of the mandrel bar.

3. The lubricant for the production of seamless tubes as defined in claim 1, wherein the water-insoluble fine synthetic resin particles comprise a synthetic resin having a glass transistion point lower than 55° C.

4. The lubricant for the production of seamless tubes as defined in claim 1, wherein the particle diameter of the fine gilsonite particles and the fine graphite powder is no greater than 100 μm.

5. The lubricant for the production of seamless tubes as defined in claim 1, wherein the water-insoluble fine synthetic resin particles comprise a synthetic resin selected from the group consisting of acrylic resin, polyethylene and copolymers containing vinyl acetate.

6. The lubricant for the production of seamless tubes as defined in claim 3, wherein the water-insoluble fine synthetic resin particles comprise a synthetic resin having a glass transition point no greater than 40° C.

7. The lubricant for the production of seamless tubes as defined in claim 1, wherein said lubricant comprises about 30 parts by weight of water-insoluble fine synthetic resin particles, about 15 parts by weight of fine gilsonite particles and about 55 parts by weight of fine graphite powder.

8. The lubricant for the production of seamless tubes as defined in claim 1, wherein said lubricant resin particles, gilsonite particles and graphite powder comprise from about 40 to about 70% by weight of said lubricant, the balance being water.

* * * * *